US006669245B2

(12) United States Patent
Ruano Aramburu et al.

(10) Patent No.: US 6,669,245 B2
(45) Date of Patent: Dec. 30, 2003

(54) PUSHING DEVICE FOR THE EMERGING OF THE BOLT IN LOCKS

(75) Inventors: Luis Angel Ruano Aramburu, Guipuzcoa (ES); Fermin Gomez Gonzalez, Guipuzcoa (ES)

(73) Assignee: Talleres de Escoriaza, S.A. (ES)

( * ) Notice: Subject to any disclaimer, the term of this patent is extended or adjusted under 35 U.S.C. 154(b) by 0 days.

(21) Appl. No.: 10/147,189

(22) Filed: May 16, 2002

(65) Prior Publication Data

US 2002/0175524 A1 Nov. 28, 2002

(30) Foreign Application Priority Data

May 23, 2001 (ES) ..... 200101175

(51) Int. Cl.[7] ..... E05C 1/08

(52) U.S. Cl. ..... 292/169.14; 292/336.3; 292/DIG. 65; 292/DIG. 4; 292/DIG. 44

(58) Field of Search ..... 292/34, 36, 40, 292/336.3, 169.14, 336.5, DIG. 4, DIG. 44, 93, DIG. 65

(56) References Cited

U.S. PATENT DOCUMENTS 5,782,114 A * 7/1998 Zeus et al. ..... 70/109
5,813,255 A * 9/1998 Tell et al. ..... 70/107
6,266,981 B1 * 7/2001 von Resch et al. ..... 70/107
6,302,453 B1 * 10/2001 Norton ..... 292/169.21
6,302,456 B1 * 10/2001 Errani ..... 292/332
6,393,878 B1 * 5/2002 Fayngersh et al. ..... 70/107

FOREIGN PATENT DOCUMENTS

GB 2 268 969 1/1994

* cited by examiner

*Primary Examiner*—Robert J. Sandy
*Assistant Examiner*—Dinesh Melwani
(74) *Attorney, Agent, or Firm*—Nields & Lemack

(57) ABSTRACT

Pushing device for the emerging of the bolt in locks, characterized in that the handle axis (1) has a coaxial lever (8), coupled rotationally, which turns along with it in the conventional direction of opening, being equipped with an independent turning in the opposite direction, or anti-opening turning, whose lever (8) has a peripheral lug (8*a*) which is applied, in relation to the anti-opening turning, against a fin (9*a*) of the rocker (9), mounted spring-loaded with a projection (9*b*) applied against a heel (10*a*), belonging to a counter-rocker (10), having a front piece (10*b*) applied against a transverse lug (6*b*) of the latch plate (6), there being a rotating rod (11) mounted with a free turning coaxially with the rocker (9), having arms, a rocker (11*a*), and a bolt (11*b*), rotationally spaced out by an angle preferably less than that needed to simultaneously make contact with the fin (9*a*) of the rocker (9) in the state of rest and with the back of the bolt (3) in retracted state.

4 Claims, 3 Drawing Sheets

PUSHING DEVICE FOR THE EMERGING OF THE BOLT IN LOCKS

FIELD OF THE INVENTION

This invention concerns a pushing device for the emerging of the bolt in locks which comprise at least: a handle axis which, with a radial arm, retracts a slide in the rotational maneuver to open the lock, a bolt, a connecting rod which drives the retraction of the bolt during said opening maneuver, a bolt tail, several trapping notches cut into the upper edge of this bolt tail, a latch plate sliding vertically, a latch belonging to the latch plate, a spring which drives the latch plate into a bottom position, where the latch is lodged in certain trapping notches, and which allows an upper position of this latch plate in which this latch is released from the trapping notches. Generally, there will also be a key mechanism able to actuate the emerging and the entering of the bolt.

BACKGROUND OF THE INVENTION

It frequently happens that robbers enter homes while their residents are still inside.

This happens when one uses a conventional type of lock which is very widespread, having a slide and bolt, and where routinely or for comfort, displaying an excess of confidence, the locking of the door is entrusted solely to the slide, omitting to also lock the bolt with the key from the inside. Then the robber has only to retract the latch by the classical technique of pushing it with the edge of a credit card or the like, and he will be able to enter the dwelling. Closing of the bolt with a key from the inside would have prevented this possibility; however, this option has a negative side, namely, the impediment given a situation where the dwelling has to be exited in an emergency and the key is not ready to hand, or a child of young age is the one who has to perform the maneuver in a condition of excitement or nervousness.

These problems are solved by automatic and emergency-exit locks in which, when the door is brought up to the frame, the bolts are automatically closed, and there is an inside handle which is actuated to produce the total opening of the lock (latch and bolts). But these locks are very costly and require a very precise installation of the leaf and frame in order to function properly, so that they are only installed in a very small percentage.

The invention proposes to furnish a simple solution, one with similar functional performance for the more conventional and common locks mentioned in the beginning. In that the bolt can be removed from the inside by certain permanently available means, easy to operate and different from the key; and at the same time, they provide an emergency function which enables a total opening of the lock from the inside while the bolt is thrown.

SUMMARY OF THE INVENTION

Given this state of affairs, the present invention proposes a device which is applicable to the type of locks explained in the field previously specified for same; whose design has a special arrangement in that said handle axis has a coaxial lever which is rotationally coupled to same in a way that it turns along with it in the conventional direction of opening, yet it has an independent turning in the opposite direction, or anti-opening turning, whose lever has a peripheral lug which is applied, in relation to said anti-opening turning, against a fin of a rocker which is mounted spring-loaded and which has a projection which is applied against a heel belonging to a counter-rocker having a front piece which is applied, upward from below, against a transverse lug of said latch plate, there being a rotary rod which is mounted with free turning coaxially with said rocker and which has certain arms, a rocker, and a bolt, which are rotationally spaced out by an angle appropriately less than that needed to simultaneously make contact with the fin of the rocker in a state of rest and with the back of the bolt in a retracted condition, and this rotational angular difference remains, in the state of rest, between said fin and said rocker arm with an appropriate amplitude, depending on the vertical distance between the coupled and uncoupled positions of the latch in the trapping notches.

According to another characteristic of the invention, said rocker has a rotational operating run such that it reaches a flipped position in which its projection remains applied against the opposite side of the heel of the counter-rocker, at the same time as one wall of this counter-rocker is interfering with the start of the operating travel of a transverse flange of said connecting rod, which is necessary in order for this rod to drive the retraction of the bolt.

This arrangement of the proposed device enables the inside handle, preferably a doorknob, to perform an anti-opening turn from its position of rest with the bolt retracted. This anti-opening turn develops in two adjacent phases: a first one in which the peripheral lug of the lever pushes the fin of the rocker, making it travel the rotational angle which separates it initially from the rocker arm belonging to the rotational rod, during which travel the projection of the rocker pushes the heel of the counter-rocker and this flips, making its front end lift the transverse lug of the latch plate and produce the subsequent exiting of the latch from a respective front trapping notch of the tail of the bolt; and a second phase in which, in this state of release of the bolt, said fin of the rocker now pushes on said rocker arm of the rotary rod, making it flip, and its bolt arm drives the emerging of the bolt, during which the action of the projection of the rocker against the heel of the counter-rocker is maintained until, once the bolt has emerged, the projection of the rocker goes beyond the position of the heel of the counter-rocker and the latter recovers its initial nonflipped position and allows the latch to descend and enter into a respective rear trapping notch, for which it is aided by the driving of the corresponding spring against the transverse lug of the latch plate.

At the end of this process, said transverse flange of the connecting rod remains against said wall of the counter-rocker. Accordingly, if we now operate the handle in the opposite direction, the driving of this transverse flange against this wall will flip the counter-rocker, at the same time making the latch emerge from its trapped position in the tail of the bolt and its heel will retract enough so that the projection of the rocker elastically recovers its original position at the other side of this heel; at this moment, the path corresponding to the anti-opening turn has been cancelled and the further turning (now corresponding to the normal opening maneuver) will make the bolt be retracted by the connecting rod, while the bolt itself pushes against the bolt arm of the rotary rod so that it (being mounted with rotational freedom) recovers its initial position of the mechanism at rest.

BRIEF DESCRIPTION OF THE DRAWINGS

In order to better understand the nature of the present invention, on the enclosed drawings we represent a preferred embodiment of the invention, which is merely for illustration and not limited to this.

Figure 2:
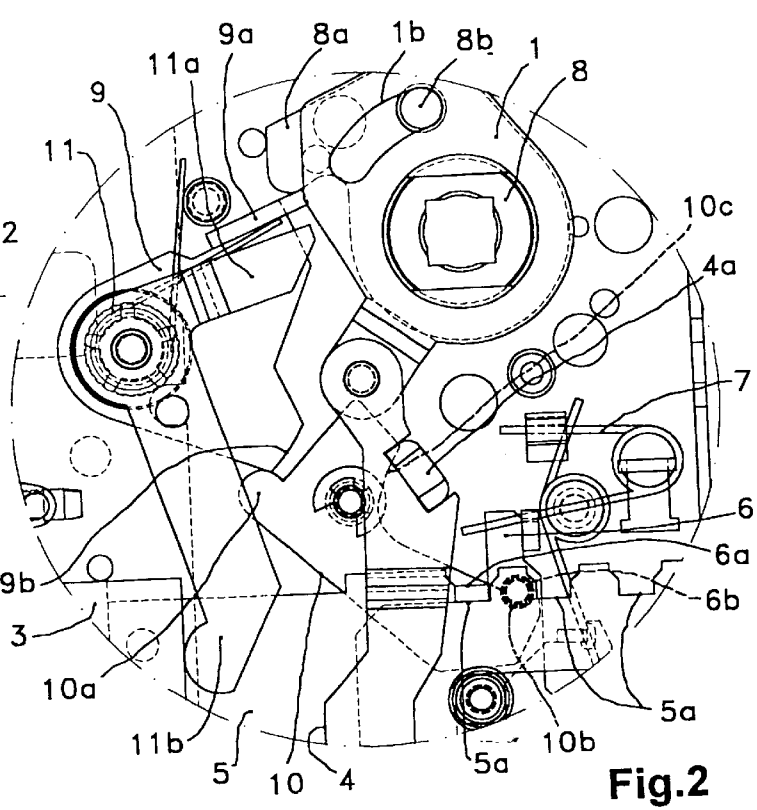
FIG. 2 is a magnification of feature II, which is encircled in FIG. 1.

The following references appear on these figures:

1. Handle axis

1*a*. Radial arm of the handle axis (1)

1*b*. Guide for the handle axis (1)

2. Slide

3. Bolt

4. Connecting rod

4*a*. Transverse flange of rod (4)

5. Tail of bolt

5*a*. Trapping notches in tail of bolt (5)

6. Latch plate

6*a*. Latch of latch plate

6*b*. Transverse lug of latch plate (6)

7. Spring for latch plate (6)

8. Lever

8*a*. Peripheral lug of lever (6)

8*b*. Transverse knob of lever (6)

9. Rocker

9*a*. Fin of rocker (9)

9*b*. Projection of rocker (9)

10. Counter-rocker

10*a*. Heel of counter-rocker (10)

10*b*. Front end of counter-rocker (10)

10*c*. Wall of counter-rocker (10)

11. Rotary rod

11*a*. Rocker arm on rotary rod (11)

11*b*. Bolt arm on rotary rod (11)

12. Knob handle

DETAILED DESCRIPTION OF THE INVENTION

With regard to the above-enumerated references and drawings, the enclosed plates illustrate a preferred embodiment of the invention, concerning a pushing device for the emerging of the bolt in locks of the type which comprise, at least: a handle axis (1) which, with a radial arm (1*a*), retracts a slide (2) in the rotary opening maneuver, a bolt (3), a connecting rod (4) which drives the retraction of the bolt (3) in said opening maneuver, a bolt tail (5), several trapping notches (5*a*) cut into the upper side of this bolt tail (5), a latch plate (6) sliding vertically, a latch (6*a*) belonging to the latch plate (6), a spring (7) which drives the latch plate (6) into a bottom position, in which the latch (6*a*) is lodged in one of the trapping notches (5*a*), and allowing an upper position for this latch plate (6), in which this latch (6*a*) is released from these trapping notches (5*a*). As will be seen in FIGS. 1, 3 and 5, the lock incorporates a knob handle (12) and comes with a key type lock mechanism.

As shown by the figures, the device according to the invention consists in that said handle axis (1) has a lever (8) coaxial with it, which is rotationally coupled to same such that it turns along with it in the conventional opening turn, yet it has an independent turning in the opposite direction, or anti-opening turn, whose lever (8) has a peripheral lug (8*a*) which is applied, relative to said anti-opening turn, against a fin (9*a*) of a rocker (9) which is mounted spring-loaded and which has a projection (9*b*) which is applied against a heel (b*a*), belonging to a counter-rocker (10) having a front end (10*b*) which is applied, upward from below, against a transverse lug (6*b*) of said latch plate (6), there being a rotary rod (11) which is mounted with free turning, coaxially with said rocker (9), and it has several arms, one for the rocker (11*a*) and one for the bolt (11*b*), which are rotationally spaced by an angle conveniently less than that necessary to produce simultaneous and respective contact with the fin (9*a*) of the rocker (9) in a state of rest and with the back side of the bolt (3) in the retracted state, and this rotational angular difference continues to exist in the state of rest between said fin (9*a*) and said rocker arm (11*a*) with an appropriate amplitude depending on the vertical distance between the coupled and uncoupled positions of the latch (6*a*) in the trapping notches (5*a*), while said rocker (9) has an operating rotational run such that it reaches a flipped position, in which its projection (9*b*) is applied against the opposite side of the heel (10*a*) of the counter-rocker (10), while a wall (10*c*) of this counter-rocker (10) is interfering with the start of the operating run of a transverse flange (4*a*) of said connecting rod (4), which is necessary in order for this rod (4) to drive the retraction of the bolt (3).

Figure 1:
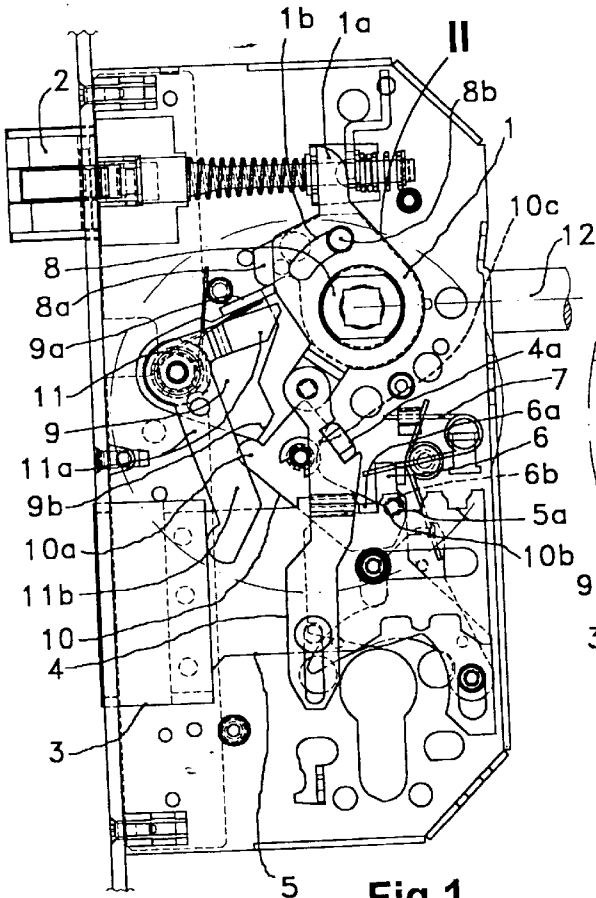
FIG. 1 shows a lock according to the invention, viewing from the outside (as if the box of the mechanism were transparent) in the condition with the slide (2) in its keeper, the bolt (3) retracted in the lock, and the handle axis (1) in the initial position for the opening movement.
Figure 4:
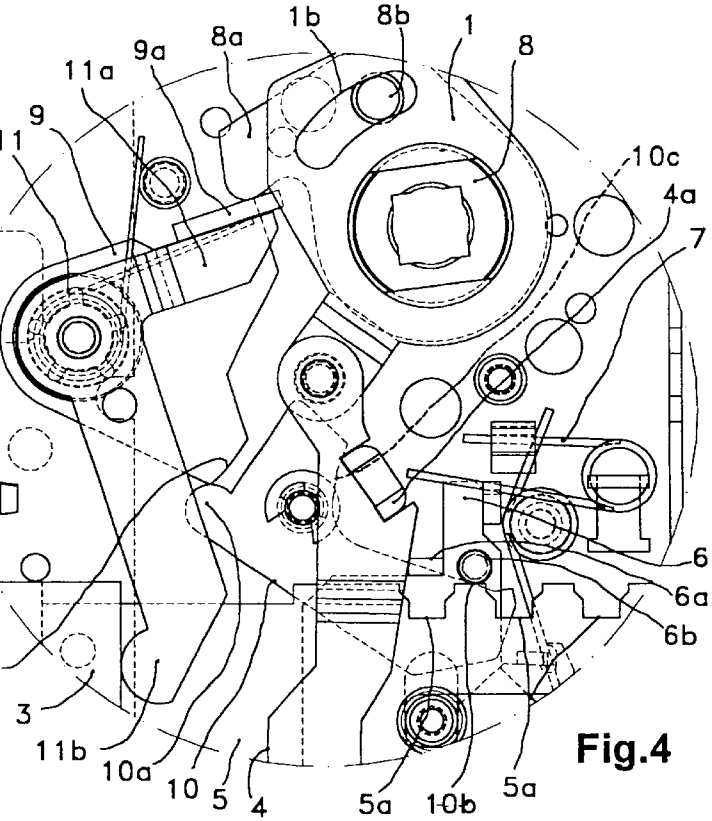
FIGS. 3 and 4 are respectively similar to FIGS. 1 and 2, but correspond to the moment when a first portion of the anti-opening run has been performed, bringing the fin (9*a*) of the rocker (9) into contact with the rocker arm (11*a*) of the rotary rod (11).
Figure 3:
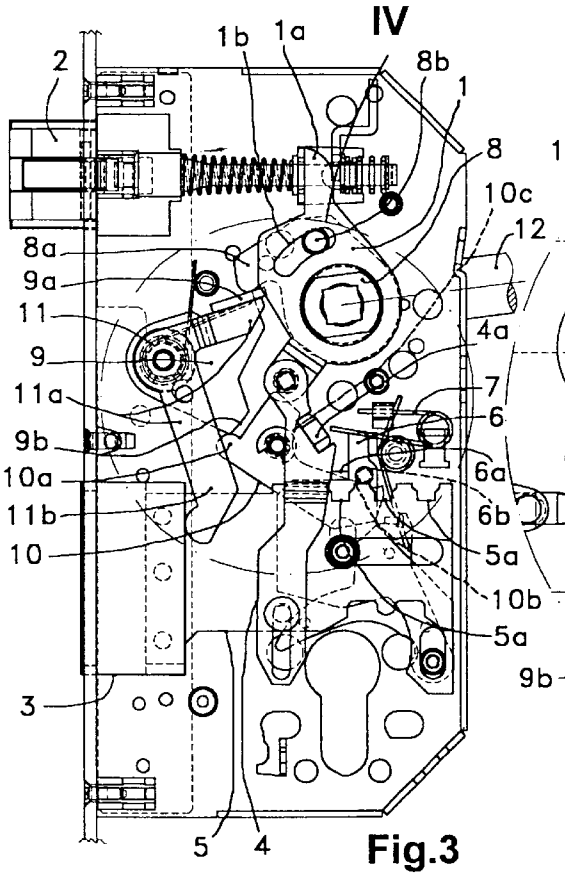
Figure 6:
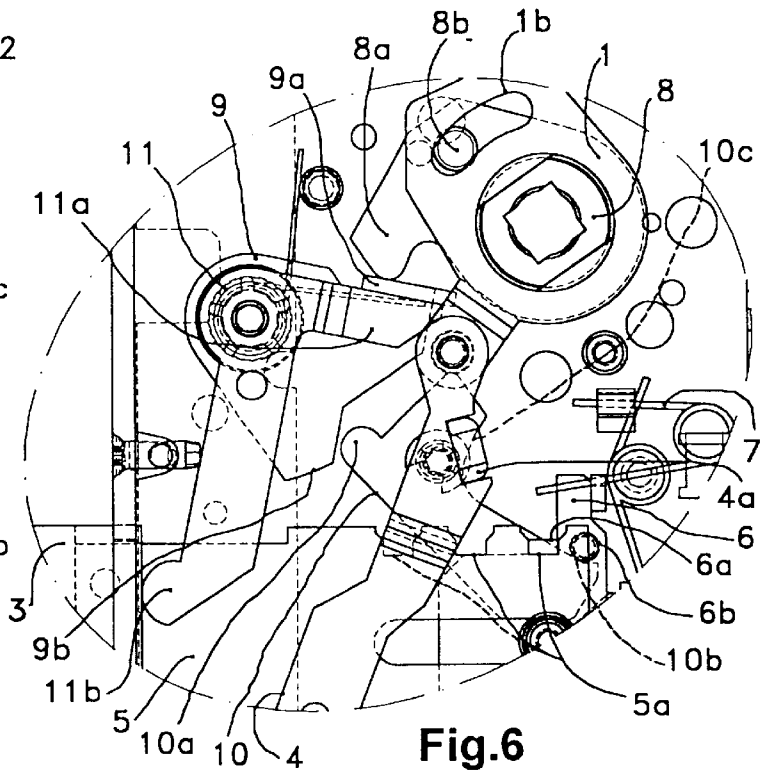
FIGS. 5 and 6 are respectively similar to FIGS. 3 and 4, but correspond to the moment when the end of the anti-opening run has been reached.
Figure 5:
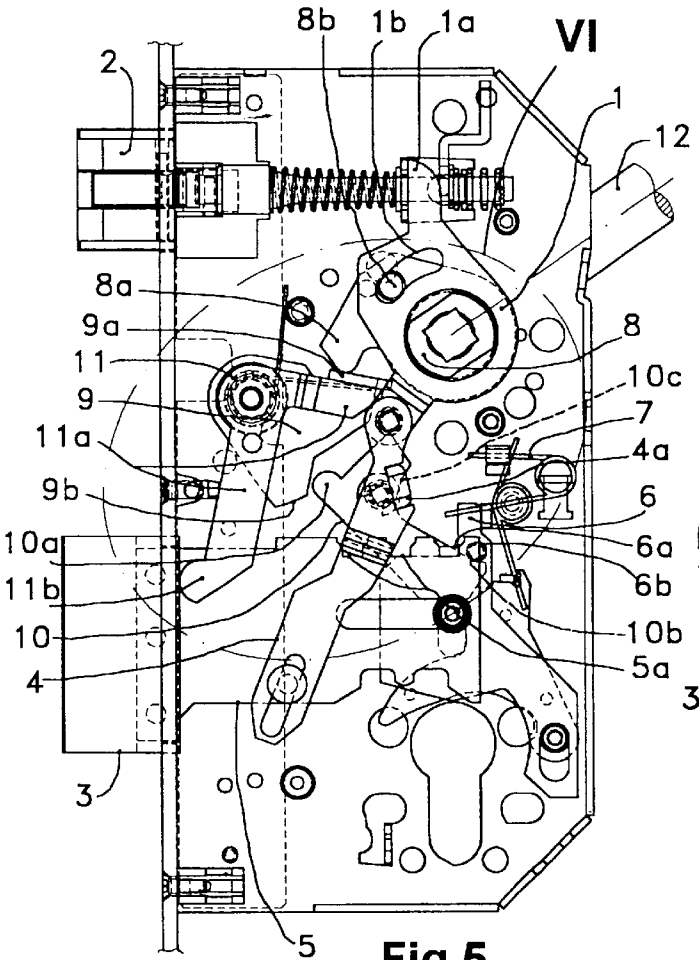

The functionality is illustrated by FIGS. 1, 3 and 5 which, with the help of their respective enlargements in FIGS. 2, 4, and 6, show sequentially the three representative positions of the maneuver of throwing the bolt (3) by an anti-opening turn of the handle axis (1) or the knob (12).

In the starting position (FIGS. 1 and 2), it is assumed that the door is in the frame, with the slide (2) inside its keeper, the bolt (3) retracted and at rest, like the conventional mechanism for the lock with the proposed device. In this position, the fin (9*a*) of the rocker (9) is in contact with the peripheral lug (8*a*) of the lever (8), but lies at a small rotational distance from the rocker arm (11*a*) of the rotary rod (11); in turn, the projection (9*b*) of the rocker (9) is in contact with the heel (10*a*) of the counter-rocker (10) and the front (10*b*) of the latter is applied at the bottom against the transverse lug (6*b*) of the latch plate (6).

The next position (FIGS. 3 and 4) is produced with a slight anti-opening rotation of the knob (12), which is necessary for the fin (9*a*) to contact the rocker arm (11*a*), and at the same time being sufficient for the front end (10*b*) to lift the transverse lug (6*b*) so that it makes the latch (6*a*) leave the front trapping notch (5*a*) in the tail of the bolt (5), thus allowing the latter to emerge freely.

The last position (FIGS. 5 and 6) shows the end of the anti-opening run and has the effect that, as the reverse action continues on the knob (12), it is converted into a flipping of the rotary rod (11) which, with its bolt arm (11*b*), drives the bolt (3) to emerge completely. During this phase, the action of the projection (9*b*) continues against the heel (10*a*), so that the counter-rocker (10) continues tilting, preventing the latch (6*a*) from descending. Only at the end of this phase does the projection (9*b*) move beyond the heel (10*a*), allowing the counter-rocker (10) to regain its position of rest and the latch (6*a*) to become inserted in a rear trapping notch (5*a*).

In this last position, note that the transverse flange (4*a*) of the connecting rod (4) remains against the wall (10*c*) of the counter-rocker. This will allow the proposed device to provide an emergency-exit operation in which, by merely actuating this knob (12) from the inside, one can totally open the lock, in this manner: at first, the actuation of the transverse flange (4*a*) pushes the wall (10*c*) and the counter-rocker (10) flips, removing the latch (6*a*) from its rear trapping notch (5*a*); this flipping has the effect that, as the actuation continues, the heel (10*a*) moves away and is overtaken by the projection (9*b*), regaining their relative initial or resting positions; the retraction of the bolt (3) is now effected by the connecting rod (4), as in a conventional opening with the knob (12); the rocker (9) automatically regains its position by the action of its spring and the rotary rod (11) does so by the actual pushing to retract the bolt (3) against the bolt arm (11*b*).

According to another characteristic of the invention, said lever (8) has a transverse knob (8*b*) which, with sliding adjustment, is passed through a guide (1*b*) of the handle axis (1), which has a rotary extent corresponding to that of said anti-opening turn.

The invention provides a solution in which said rocker (9) and rotary rod (11) are not coaxial.

What is claimed is:

1. A pushing device for the emerging of the bolt in locks, comprising: a handle axis (1) which, with a radial arm (1*a*), retracts a slide (2) in the rotational opening maneuver, a bolt (3), a connecting rod (4) which drives the retraction of the bolt (3) in said opening maneuver, a bolt tail (5), several trapping notches (5*a*) cut into the upper side of this bolt tail (5), a latch plate (6) vertically sliding, a latch (6*a*) belonging to the latch plate (6), a spring (7) which drives the latch plate (6) into a lower position, in which the latch (6*a*) is lodged in one of the trapping notches (5*a*), and which allows an upper position for this latch plate (6) in which this latch (6*a*) is released from these trapping notches (5*a*), wherein said handle axis (1) has a lever (8) coaxial with it, being rotationally coupled to same in that it turns along with it in the conventional opening direction, but it has an independent turning in the opposite direction, defining an anti-opening turn, which lever (8) has a peripheral lug (8*a*) which is applied, in relation to said anti-opening turn, against a fin (9*a*) of a rocker (9) which is mounted so as to be spring-loaded and which has a projection (9*b*) which is applied against a heel (10*a*) belonging to a counter-rocker (10), having a front end (10*b*) which is applied upward from below against a transverse lug (6*b*) of said latch plate (6), there being a rotary rod (11) which is mounted so as to be free turning and coaxially with said rocker (9) and is equipped with arms, one for the rocker (11*a*) and one for the bolt (11*b*), which are rotationally spaced by an angle less than that necessary for simultaneous and respective contact with the fin (9*a*) of the rocker (9) in the state of rest and with the back of the bolt (3) in the retracted condition, and this rotational angular difference is preserved in the state of rest between said fin (9*a*) and said rocker arm (11*a*) with an amplitude which is a function of the vertical run between the coupled and uncoupled positions of the latch (6*a*) in the trapping notches (5*a*).

2. The pushing device for the emerging of the bolt in locks, according to claim 1, further characterized in that said rocker (9) has an operating rotational run such that it reaches a flipped position in which its projection (9*b*) is applied against the opposite side of the heel (10*a*) of the counter-rocker (10), while at the same time a wall (10*c*) of this counter-rocker (10) prevents the commencement of the operating run of a transverse flange (4*a*) of said connecting rod (4), which is necessary for this rod (4) to drive the retraction of the bolt (3).

3. The pushing device for the emerging of the bolt in locks, according to claim 1, further characterized in that said lever (8) has a transverse knob (8*b*) which, with sliding adjustment, is passed through a guide (1*b*) of the handle axis (1), having a rotary extent in accordance with that of said anti-opening turn.

4. The pushing device for the emerging of the bolt in locks, according to claim 2, further characterized in that said lever (8) has a transverse knob (8*b*) which, with sliding adjustment, is passed through a guide (1*b*) of the handle axis (1), having a rotary extent in accordance with that of said anti-opening turn.

* * * * *